US005094370A

United States Patent [19]

Specht

[11] Patent Number: 5,094,370

[45] Date of Patent: Mar. 10, 1992

[54] METHOD AND FIXTURE FOR CENTER-LOOP BOW MAKING

[76] Inventor: Lahna J. Specht, 17750 Fruitport Rd., Spring Lake, Mich. 49456

[21] Appl. No.: 638,198

[22] Filed: Jan. 7, 1991

[51] Int. Cl.[5] ..... A41H 43/00

[52] U.S. Cl. ..... 223/46; 28/147

[58] Field of Search ..... 223/44, 46; 2/244, 271, 2/243 R; 289/17, 18.1; 28/147, 149, 150

[56] References Cited

U.S. PATENT DOCUMENTS

| | | | |
|---|---|---|---|
| 975,355 | 11/1910 | Gurtler | 223/44 |
| 1,481,754 | 1/1924 | Stalson | 289/17 |
| 2,317,914 | 4/1943 | McIntyre | 223/44 |
| 2,527,752 | 4/1951 | Hanselman | 223/46 |
| 2,569,943 | 10/1951 | Mitchell | 223/46 |
| 2,825,592 | 3/1958 | Semple | 289/17 |
| 3,073,636 | 1/1963 | Boutwell | 289/17 |
| 3,462,049 | 8/1969 | Smith | 223/46 |
| 3,833,157 | 9/1974 | Lofton | 223/46 |
| 4,375,197 | 3/1983 | Hinson | 289/18.1 |
| 4,410,113 | 10/1983 | Palombo | 223/46 |
| 4,714,182 | 12/1987 | Hecht | 223/46 |
| 4,815,772 | 3/1989 | Lizarraga | 289/17 |
| 4,989,906 | 2/1991 | Peverley | 289/17 |

*Primary Examiner*—Werner H. Schroeder
*Assistant Examiner*—Amy Brooke Vanatta
*Attorney, Agent, or Firm*—Price, Heneveld, Cooper, DeWitt & Litton

[57] ABSTRACT

A fixture and method for center-loop bow making is provided. The fixture is made of a one-piece resilient material such as a flat piece of neoprene, and includes two lobes which form a necked inlet which leads into an enlarged pocket. The necked inlet releasably retains ribbon placed therethrough into the pocket and is aided by the frictional characteristics of the fixture material and the expanding ribbon material. The lobes are designed to permit a center-loop to be formed over the center of the bow and also to facilitate tying of the bow around the ribbon held in the enlarged pocket. The lobes resiliently bend out of the way to release the ribbon held in the pocket after the bow is made. The method includes forming the bow from ribbon in the fixture and looping the last portion of the ribbon over the center of the bow to form a center-loop which covers the center of the bow. The method also includes bending the lobes of the fixture out of the way to release the bow formed therein.

16 Claims, 2 Drawing Sheets

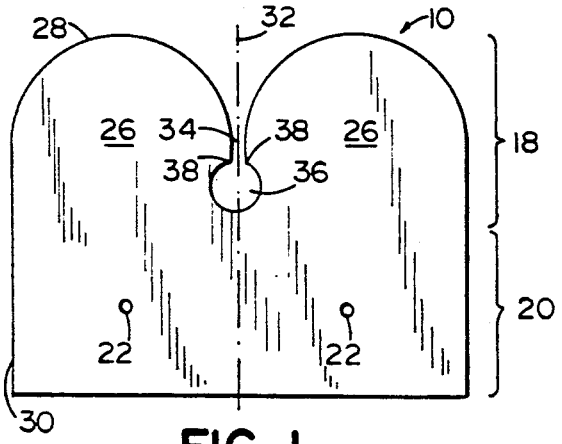
FIG. 1
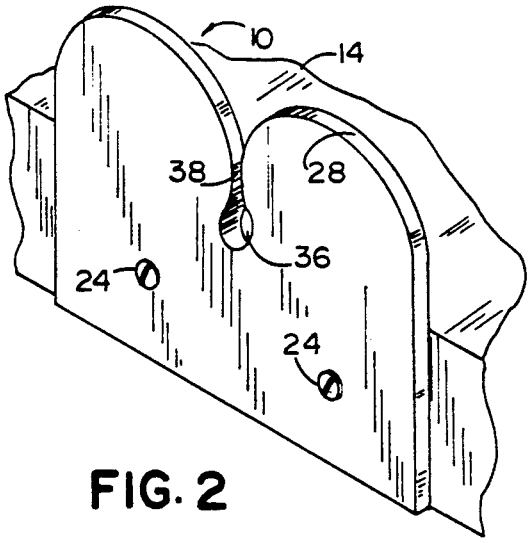
FIG. 2
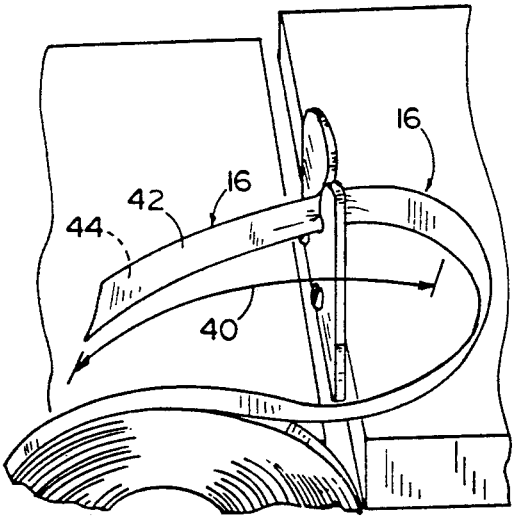
FIG. 3
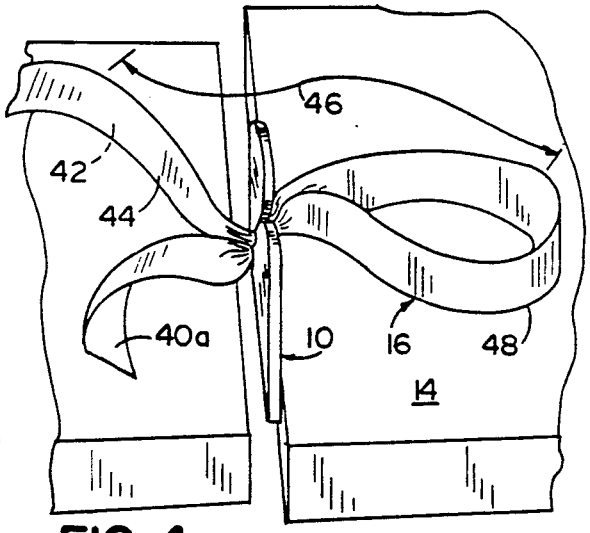
FIG. 4
FIG. 5
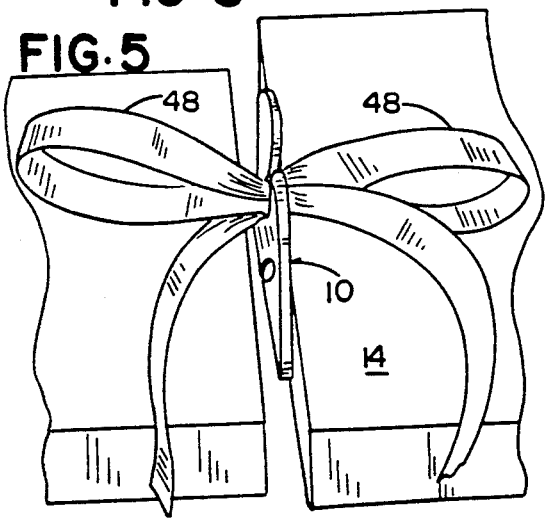
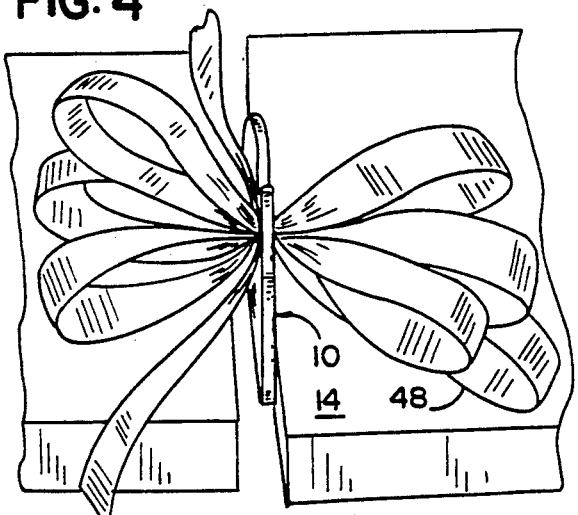
FIG. 6

METHOD AND FIXTURE FOR CENTER-LOOP BOW MAKING

BACKGROUND OF THE INVENTION

The present invention pertains to a bow making fixture and particularly to one for making custom center-loop bows.

Bows are an important part of presenting an attractive package wrap. However, the cost of maintaining an inventory of bows to fit all occasions and match all color combinations is prohibitively expensive. Further, as styles and desires change, considerable inventory could be made obsolete and, thus substantially worthless. Thus, there is a need for bow making fixtures which allow custom bows to be made as needed.

A variety of bow making fixtures presently exist. However, present fixtures suffer from complexity and lack of flexibility. Particularly, known fixtures do not allow a user to make a center-loop bow which includes a loop extending over the center of the bow. Such center-loop bows are desirable because the center-loop hides the less attractive area of the bow where the bow is tied. In order to custom-make a center-loop bow, the designer is required to hand-form the ribbon, with one loop made around a finger, or thumb, to form the center-loop. This is difficult and requires extensive practice to develop the skills to create pleasing bows. Furthermore, the degree of complexity that can be put into the center-loop bow has been limited because of the hand coordination required. Therefore, an unfilled need exists for an inexpensive and easy to use fixture for center-loop bow making.

SUMMARY OF THE PRESENT INVENTION

The present invention provides a fixture for making center-loop bows from ribbon. The fixture includes a holder having two lobes defining a necked inlet to receive ribbon which leads to an enlarged pocket for retaining the ribbon. The lobes are shaped to permit a center-loop to be formed on the bow as the bow is made, and also to release the bow after the bow is tied. In the preferred embodiment, the fixture is made from neoprene which frictionally retains the ribbon in the pocket, and also resiliently releases the bow after being tied.

A method for making a center-loop bow according to the invention includes providing a holding fixture having two lobes which define a necked inlet opening to an enlarged pocket for releasably retaining ribbon placed therein. Successive portions of ribbon are placed through the inlet into the pocket to form the loops of a bow. A last portion of the ribbon is then looped over the center of the bow to form a center-loop. The bow may then be tied and removed from the fixture.

Such a fixture, and its method of use, provides a low cost and easily used fixture for making bows, and particularly, for making center-loop bows. These and other features, objects and advantages of the present invention will become apparent upon reading the following description thereof together with reference to the accompanying drawings in which:

BRIEF DESCRIPTION OF THE DRAWINGS

FIG. 1 is a front view of a center-loop bow making fixture embodying the present invention;

FIG. 2 is a perspective view of the fixture in FIG. 1 shown attached to a work surface;

FIG. 3–11 illustrate a method of making a center-loop bow according to the invention.

DETAILED DESCRIPTION OF THE PREFERRED EMBODIMENTS

Figure 7:
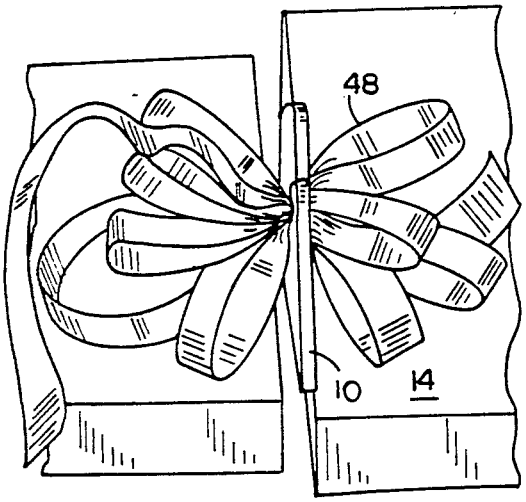

Referring now specifically to the drawings and the illustrative embodiments depicted therein, a center-loop bow making fixture 10 embodying the present invention, is provided that is particularly adapted for making custom center-loop bows 12 (FIGS. 1 and 2). In the preferred embodiment, fixture 10 is designed to be nailed or screwed against the side of a worksurface 14 and protrudes upwardly therefrom.

In the illustrated embodiment, fixture 10 is made from a flat sheet of resilient and flexible material, such as rubber or neoprene, one quarter inch in thickness. Neoprene is particularly adapted to this use since it combines an appropriate level of stiffness with resiliency. Further, neoprene has a coefficient of friction sufficient to facilitate use of fixture 10 as described below.

Fixture 10 is generally divided into an upper half 18 and a lower half 20. Lower half 20 is generally rectangular in shape and is adapted to abut an end of worksurface 14. Lower half 20 includes two or more holes 22 spaced a distance apart to provide a secure non-rotatable attachment of fixture 10 to worksurface 14 by screws 24 which extend through holes 22. Upper half 18 includes two lobes 26 which are integrally connected to lower half 20 and which extend upwardly therefrom. Each lobe 26 has an upper edge 28 which is generally semicircular in shape and extends from outer edge 30 arcuately upwardly and toward a center line 32. Lobes 26 define a necked inlet 34 at center line 32 in the area where upper edges 28 approach each other. Necked inlet 34 defines a funnel shaped inlet which narrows to about 1/16" in width. Necked inlet 34 opens downwardly to an enlarged pocket 36 which is generally centrally located in fixture 10. In the preferred embodiment, enlarged pocket is about ¼" and is positioned slightly above worksurface 14 as illustrated in FIG. 2 so that ribbon 16 can be placed therein.

Ribbon 16 is looped back and forth across fixture 10 to form bow 12 as described hereinafter. Necked inlet 34 and enlarged pocket 36 cooperate to retain ribbon 16 as ribbon 16 is thrust downwardly through necked inlet 34 into pocket 36. Initially, lobes 26 resiliently cooperate to allow ribbon 16 to pass through necked inlet 34 into enlarged pocket 36. Subsequently, lobes 26 trap ribbon 16 within enlarged pocket 36 by action of corners 38 which define the narrowed entrance to enlarged pocket 36. Additionally, the frictional resistance of the neoprene on ribbon 16 tends to grip and prevent ribbon 16 from escaping. Further, ribbon 16, which gathers as it slips into inlet 34, expands as it enters pocket 30, thus preventing accidental release.

METHOD OF USE

Center-loop bow making fixture 10 is attached to the end of worksurface 14 with enlarged pocket 36 located slightly above worksurface 14. A first portion 40 having end 40*a* of a continuous strand of ribbon 16 is placed above necked inlet 34 with a first side 42 facing upwardly and a second side 44 facing downwardly (FIG. 3). First portion 40 of ribbon 16 is then forced downwardly through necked inlet 34 into enlarged pocket 36 Ribbon 16 is first gathered as it passes into necked inlet 34 and then expands as it enters enlarged pocket 36. Ribbon 16 is then looped around and a second portion 46 of ribbon 16 is positioned over inlet 34 (FIG. 4). At the same time, second portion 46 is rotated 180° such that ribbon first side 42 now faces downwardly and ribbon second side 44 now faces upwardly. Second portion 46 of ribbon 16 is then forced downwardly through necked inlet 34 into enlarged pocket 36 on top of first portion 40, thus forming a first bow loop 48.

Figure 8:
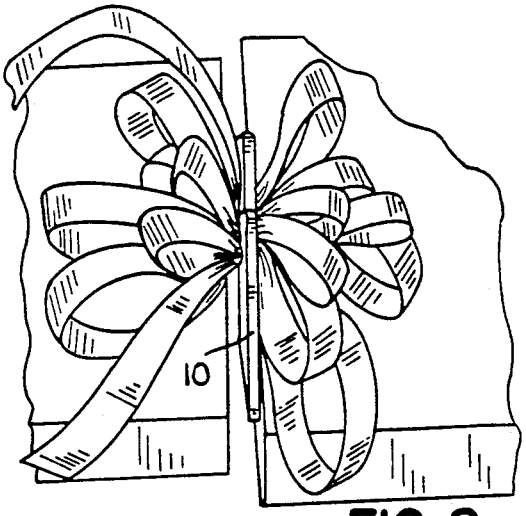

Ribbon 16 is then looped and twisted 180° to form yet another bow loop 48 (FIG. 5). Again, ribbon 16 is forced downwardly through necked inlet 34 into enlarged pocket 36. This procedure is continued on successive portions of ribbon 16 until the desired "outside" size of bow 12 is reached (FIGS. 6–8)

Figure 9:
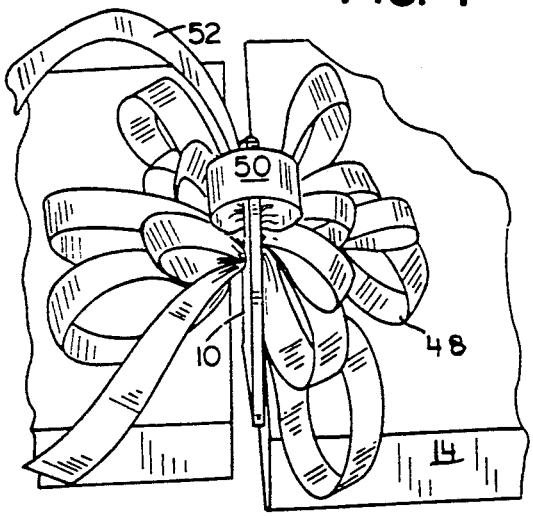
Figure 10:
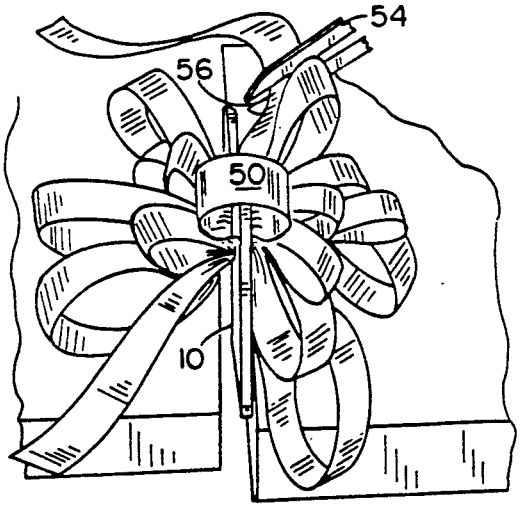

To form a center-loop 50, ribbon 16 is looped upwardly over necked inlet 34 and over the center of bow 12 (FIGS. 9 and 10). A last portion 52 of ribbon 16 is then tucked under center-loop 50 and is forced into necked inlet 34 and into enlarged pocket 36 without forcing center-loop 50 into necked inlet 34. Ribbon 16 is then cut by scissors 54 to form ends 158. Thus, center-loop 50 is left intact over the center of bow 12 covering the center of bow 12. A tie 60 is then tied around the center of bow 12 adjacent fixture 10 thus completing bow 12. Lobes 26 are then pressed sidewardly to open enlarged pocket 36 and necked inlet 34, thus releasing center-loop bow 12.

Figure 11:
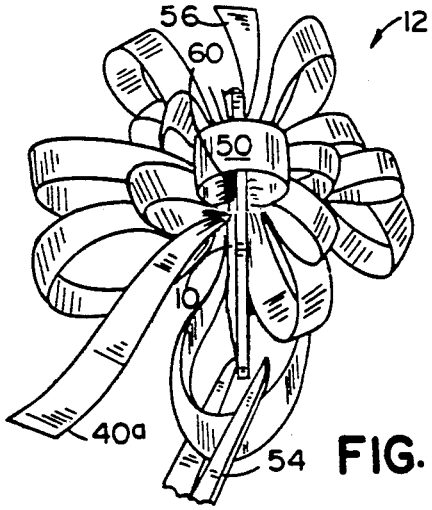
Figure 12:
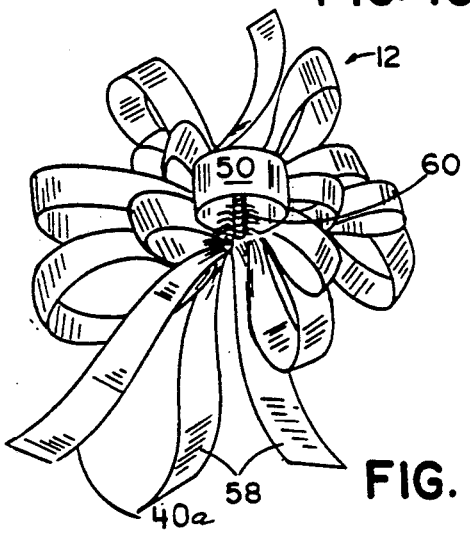
FIG. 12 illustrates a completed center-loop bow made by use of the fixture of the present invention.

A variety of different types of bows 12 can be made. For example, for a large gift or wreath, the diameter of bow 12 is determined and bow 12 is started with the longest loops 48 formed first. Each layer of loops 48 is formed sequentially shorter until the operator is ready for the last bow loop to be formed. In some bows it is desirable to cut one or more of the longer loops (FIGS. 11–12) to form a bow 12 having multiple tails 58. Furthermore, a bow may be formed from multiple separate lengths of ribbon in order to provide a more intricate bow in appearance. Thus, multiple ribbon styles, colors and designs may be combined into a single center-loop bow, which is all but impossible with a hand built center-loop bow. Additionally, trim members can be added by inserting a mounting string into the developing bow.

Thus, it is seen with the fixture for center-loop bow making of the present invention, a convenient and easy to use fixture is provided for forming custom made center-loop bows. In the preferred embodiment of the present invention, fixture 10 is particularly shaped or adapted to fit against the edge of a worksurface. The fixture is made of a material which flexibly receives ribbon without damage to ribbon and which frictionally and mechanically retains ribbon 16, yet flexibly releases ribbon 16 after the bow is fully made. It will come apparent to those skilled in the art that various modifications to the preferred embodiment of the present invention can be made without departing from the principles of the invention which is intended to be limited only by the scope of the appended claims as interpreted according to the principles of patent law including the doctrine of equivalents.

The embodiments of the invention in which an exclusive property or privilege is claimed are defined as follows.

1. A fixture for center-loop bow making comprising:

a holder having two lobs which define a funnel shaped necked inlet adapted to receive ribbon placed therein, said lobes being foreshortened so that a center-loop can be formed thereover without interference from said lobs, said holder further including an enlarged pocket connected to said necked inlet for receiving said ribbon, said necked inlet cooperating with said pocket to retain said ribbon slipped through said necked inlet into said pocket; and means for slidably releasing said ribbon retained in said pocket.

2. The fixture defined in claim 1 wherein said holder is made of a rubber-like material that frictionally engages said ribbon reducing the tendency of said ribbon to slip free.

3. The fixture defined in claim 1 wherein said fixture is comprised of a single piece of resilient material that frictionally engages said ribbon.

4. The fixture defined in claim 3 wherein said material is elastomer.

5. The fixture defined in claim 3 wherein said material is neoprene.

6. The fixture defined in claim 3 wherein said inlet is smaller than 1/16".

7. The fixture defined in claim 6 wherein said pocket is about ¼" in diameter.

8. The fixture defined in claim 1 wherein said lobes can be resiliently bent to release said bow from said enlarged pocket.

9. The fixture defined in claim 1 wherein said holder is formed from a flat sheet of material.

10. The fixture defined in claim 9 wherein said holder is adapted to be secured to an end of a worksurface.

11. A method for making center-loop bows from ribbon comprising the steps of:

providing a holding fixture having two lobes which define a funnel shaped necked inlet opening to an enlarged pocket for releasably retaining ribbon placed therein;

placing a first portion of a strand of ribbon through said necked inlet into said pocket;

placing successive portions of a strand of ribbon through said necked inlet into said pocket to form loops in the shape of a bow;

looping a last portion of one said strand of ribbon over said necked inlet to form a center-loop which covers said necked inlet;

placing an end of said last portion of ribbon through said inlet and leaving said center-loop in place over said necked inlet.

12. The method in claim 11, further including providing a tie for said bow, tying said tie around said portions retained in said pocket while leaving said center-loop intact over said necked inlet, and releasing said bow from said holding fixture.

13. The method defined in claim 11 including the step of twisting said ribbon 180° between each of said successive portions before placing said successive portions into said inlet and said pocket.

14. The method defined in claim 11 wherein said fixture is made of a resilient material and the method includes the step of bending said lobes to release said ribbon retained in said pocket.

15. The method defined in claim 11 wherein said strand of ribbon is a continuous length of ribbon.

16. The method defined in claim 11 wherein said strand of ribbon includes at least two separate pieces of ribbon.

* * * * *